United States Patent [19]

Knecht

[11] Patent Number: 4,732,276

[45] Date of Patent: Mar. 22, 1988

[54] HINGED-LID PACKAGE

[75] Inventor: Siegfried Knecht, Gevelsberg, Fed. Rep. of Germany

[73] Assignee: Maschinenfabrik Alfred Schmermund GmbH & Co., Gevelsberg, Fed. Rep. of Germany

[21] Appl. No.: 93,107

[22] Filed: Aug. 28, 1987

Related U.S. Application Data

[63] Continuation of Ser. No. 867,781, May 27, 1986.

[30] Foreign Application Priority Data

May 31, 1985 [DE] Fed. Rep. of Germany ..... 3519485

[51] Int. Cl.[4] ..... B65D 85/10

[52] U.S. Cl. ..... 206/624; 206/268; 206/273; 206/621; 229/160.1; 53/449; 220/262

[58] Field of Search ..... 206/268, 271, 273, 621, 206/624; 229/44 R, 44 CB; 53/172, 175, 449, 462, 484, 491; 220/461, 462

[56] References Cited

U.S. PATENT DOCUMENTS

| | | | |
|---|---|---|---|
| 1,648,156 | 11/1927 | Tejada | 206/268 |
| 2,166,389 | 7/1939 | Bergstein | 53/449 |
| 2,266,054 | 12/1941 | Lowey et al. | 53/491 |
| 2,758,520 | 8/1956 | Hepworth | 53/449 |
| 2,950,043 | 8/1960 | Ringler | 229/44 CB |
| 2,951,627 | 9/1960 | Wenzel | 229/44 CB |
| 2,963,214 | 12/1960 | Leone et al. | 229/44 CB |
| 3,307,770 | 3/1967 | Wysocki | 206/624 |
| 3,910,486 | 10/1975 | Stone | 206/624 |
| 3,944,066 | 3/1976 | Niepmann | 206/273 |
| 4,121,756 | 10/1978 | Focke et al. | 229/44 CB |
| 4,236,663 | 12/1980 | Krautter et al. | 229/44 CB |
| 4,303,191 | 12/1981 | Foster et al. | 229/44 CB |
| 4,325,482 | 4/1982 | Feeser | 229/44 CB |
| 4,392,338 | 7/1983 | Fox | 229/44 CB |
| 4,413,464 | 11/1983 | Larsson et al. | 53/449 |
| 4,614,297 | 9/1986 | Davis et al. | 206/807 |

FOREIGN PATENT DOCUMENTS

| | | | |
|---|---|---|---|
| 654558 | 12/1962 | Canada | 229/44 CB |

*Primary Examiner*—David T. Fidei

*Attorney, Agent, or Firm*—Chilton, Alix & Van Kirk

[57] ABSTRACT

A box with an integral hinged lid is formed from a blank, typically by folding the blank about an open-ended inner wrapper containing the article to be packaged. Prior to opening of the package the lid is joined to the front of the package by integral connecting member which are easily broken. The lid is defined, in part, by lateral tabs of triangular shape and a narrow tab of trapezoidal shape which, during folding of the blank, serve to fold the open end of the inner wrapper.

15 Claims, 10 Drawing Figures

HINGED-LID PACKAGE

This is a continuation of co-pending Ser. No. 867,781, filed on May 27, 1986.

BACKGROUND OF THE INVENTION

1. Field of the Invention

The present invention relates to packages having a generally cuboid shape and particularly to packages which receive plural articles which are confined within an inner wrapper. More specifically, this invention is directed to a method for the formation of generally cuboid-shaped packages and especially to package blanks which may be formed into such packages in accordance with the said process. Accordingly, the general objects of the present invention are to provide novel and improved articles, i.e., packages and package blanks, and methods of such character.

2. Description of the Prior Art

While not limited thereto in its utility, the present invention has been found to be particularly well suited for use in the packaging of cigarettes. It is common practice in the cigarette packaging art to envelope the product in a paper inner wrapper about which a "box" having a hinged lid is formed by folding a box blank. There are two general types of cigarette packaging systems which are commercially employed. These packaging systems are known in the art as "side-folding" and "bottom-folding" packers. In both cases, where hinged-lid packages are to be produced, the apparatus required has been complicated and thus costly. Also, in both types of known packaging systems it has been common practice to first seal the cigarette block within the inner wrapper and then fold the box blank, i.e., the outer wrapper, around the inner wrapper. In accordance with conventional prior art practice, the hinged lid has been formed from a portion of the box blank which is located entirely on the side of the blank which defines the rear side of the outer wrapper when the package is completed. This has resulted in the hinged lid being connected to the box only by means of a hinge line.

One example of a prior art technique for the formation of hinged-lid packages is depicted in British Patent No. 852,447. In the technique of this British patent the front and rear sides of a box are connected to one another via a side-wall tab. The front and cover walls of the hinged lid are separated from the adjacent front and side walls of the box by means of an incision, but are connected laterally to the remaining portions of the blank from which the box is formed. The technique of British Patent No. 852,447 has the disadvantages that the package blank must be folded on a bottom-folding packer and the inner wrapper must be completely closed about the contents of the package before the blank is folded into the hinged-lid box.

Published German patent application No. 2,551,427 depicts another technique for forming hinged-lid packages which, as is the case with the technique of the above-mentioned British patent, is suitable only for implementation with a bottom-folding packer. Bottom folding packers are inherently more complex apparatus than are side-folding packers. This published German application suggests the provision of connecting bridges to the front side and side-wall tabs of the box in the region of the severed cut between the front and side walls of the hinged lid.

SUMMARY OF THE INVENTION

The present invention overcomes the above-briefly described and other deficiencies and disadvantages of the prior art by providing a novel package blank and a method for the formation of that novel blank into a unique hinged-lid package of generally cuboid shape. The technique of the present invention has the very distinct advantage of being capable of practice on a side-folding packer. Accordingly, the hinged-lid package of the present invention may be formed in a manner which is simplified, and thus through the use of apparatus which is less complex, when compared to the prior art.

A package blank in accordance with the present invention has, in the customary manner, panels which define the front, back, bottom and sides of a container when suitably folded. The package blank also includes a two section portion which may be folded into a lid, the lid defining portion having sections which form a covering wall, lateral end tabs, side walls, a front wall and a rear wall of a hinged lid. The rear wall defining section of the hinged lid is provided with a tab which is free on three sides and which has a width which is less than the width of the combined inner wrapper and its contents which is to be received within the box. Also, the lateral end tabs of the blank are preferably of triangular shape. Further, the front and side walls of the hinged lid are connected to adjacent panels of the package blank, namely respectively the container front and side wall defining panels, by narrow portions which bridge a severing cut.

The process of the present invention employs the above-described blank and folds that blank around an inner wrapper which is open at the end thereof which will correspond to the hinged-lid. During the folding process, the lateral end tabs of the lid defining portion are folded inwardly and thus cause the folding of the lateral tips or edges of the inner wrapper. The tab which extends from the rear wall of the hinged lid, the said tab being free on three sides, is thereafter folded inwardly thus causing the inward folding of the bottom-fold portion of the inner wrapper. Finally, the covering wall portion of the hinged lid is folded inwardly thus causing the folding of the top-fold portion of the inner wrapper completing the closing of the package.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE DISCLOSED EMBODIMENT

Figure 1:
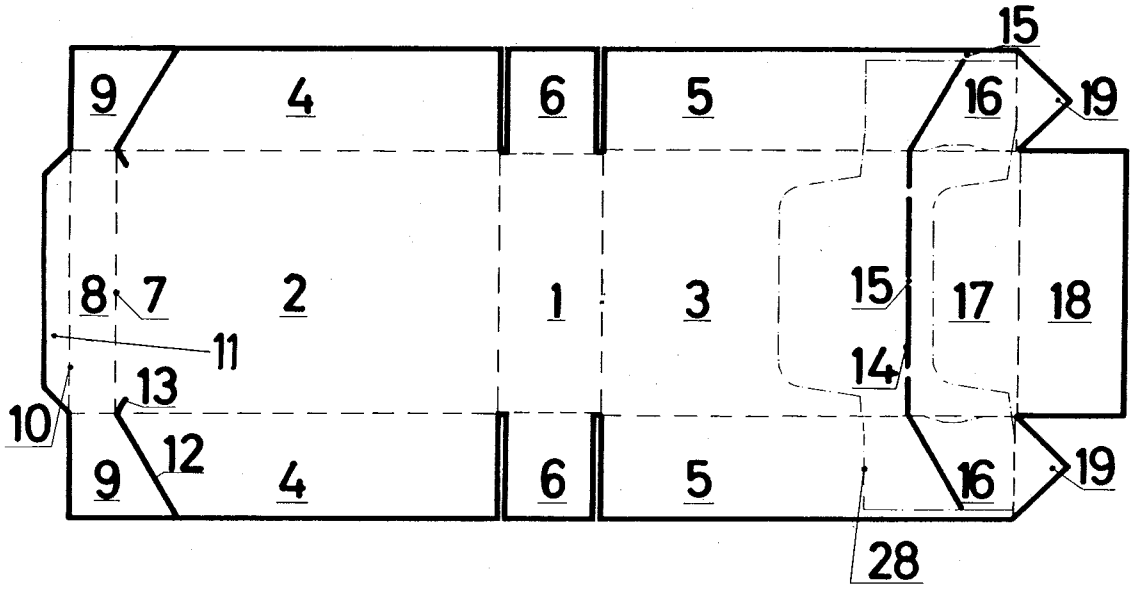
FIG. 1 is a plan view of a blank for a hinged-lid package in accordance with the present invention.

With reference to FIG. 1, a package blank in accordance with the preferred embodiment of the invention comprises a box bottom defining portion 1 which is connected to a rear side defining portion 2 and a front side defining portion 3 by means of preformed score or fold lines. The package rear side defining portion 2 is connected laterally to inner side-wall defining tabs 4 also by scored lines. Similarly, the package front side defining portion 3 is connected to outer side-wall defining tabs 5 via scored lines. The bottom defining portion 1, or alternatively the inner side-wall defining tabs 4, is provided with lateral bottom-end tabs 6 which are located between the side-wall defining tabs 4, 5 as shown. The rear side 2 of a package formed from the blank of FIG. 1 is limited by a scored hinge line 7 which connects the rear side defining portion 2 to a blank portion 8 which will define the rear wall of a hinged lid. Lid inner side wall defining portions are connected to the hinged lid rear wall defining portion 8 by means of further fold lines. A trapezoidal shaped tab 11 extends from lid defining rear wall 8 at the side thereof opposite to the package rear side defining wall 2. The width of tab 11 is relatively small, for the reasons to be discussed below, and the tab 11 is free, i.e., not connected to the remainder of the package blank, on three sides. The junction between the tab 11 and wall defining portion 8 is defined by a preformed score line 10.

The inner side wall defining tabs 4 are separated, by means of cuts 12, from the lid inner side wall defining portions 9. The cuts 12 have short extensions 13 which penetrate into the rear side defining portion 2. These extensions 13 of the cuts 12 make it easier to open the package which is produced from the blank. The lid inner side wall defining portions 9, which are in part defined by the cuts 12, are of trapezoidal shape.

The height of the front side of a box formed from the package blank of FIG. 1 is limited by a severing cut 14 which is interrupted by connecting bridges 15, there being five such bridges in the embodiment shown. Thus, the cut 14 extends outwardly to define the ends of the outer sidewall defining tabs 5, two of the connecting bridges 15 connecting the tabs 5 to blank portions 16 which define outer side-walls of the hinged lid. The cut 14, in the region of the side-wall defining tabs 5, extends obliquely on both sides toward the end of the blank. The lid outer side wall defining portions 16, which are in part defined by the oblique portions of the cut 14, are connected to a front wall defining portion 17 of the hinged lid via scored lines. The lid outer side wall defining portions 16 are also connected, via scored lines, to lateral end tabs 19. The cut 14 and the scored fold lines result in the lid outer side-wall defining portions 16 being of the same size and shape as the lid inner side-wall defining portions 9. The lateral end tabs 19 preferably have the shape of isosceles triangles which extend outwardly approximately one-half the width of a lid cover wall defining portion 18. This covering wall portion 18 is connected to the lid front wall defining portion 17 via a scored line. Other than the tabs 4 and 5, the side walls 9 and 16 the lateral end tabs 19 and the tab 11, all of the portions of the package blank will be of rectangular shape.

Figure 2:
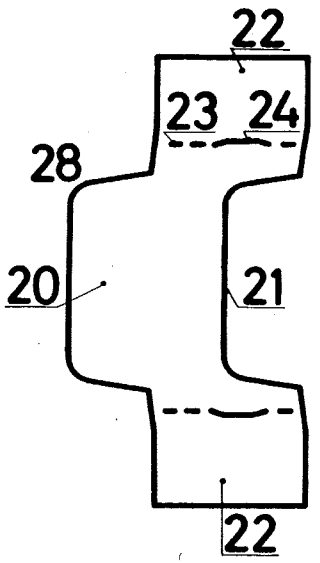
FIG. 2 is a plan view of a collar for use with the blank of FIG. 1.

FIG. 2 depicts a collar which will typically be glued to the blank illustrated in FIG. 1, in the position represented by the dot-and-dash lines on FIG. 1, before or during the folding operation. The collar consists of a middle portion 20 which provided with a cutout 21. A pair of side portions 22 extend outwardly from portion 20. Cuts 23 and 24 are formed adjacent the junction of the middle portion 20 and the side portions 22. The cuts 24 are configured such that, when the side portions 22 are bent about the lines defined by cuts 23, raised lugs will be formed by the cuts 24.

In order to produce a hinged-lid cigarette package from the package blank of FIG. 1 on a side-folding packer, a cigarette block 25 is formed and then enveloped in an inner wrapper 26. However, as may be seen from FIG. 3, by way of distinction from the prior art the inner wrapper 26 will remain open at the head end. The collar 28 of FIG. 2 is thereafter either attached separately or together with the outer-wrapper blank, indicated generally at 27 in FIG. 3, to the inner wrapper. Thus, the collar 28 is folded, either separately or together with the blank 27, around the partially formed package comprising the block of cigarettes 25 and open ended inner wrapper 26.

Figure 4:
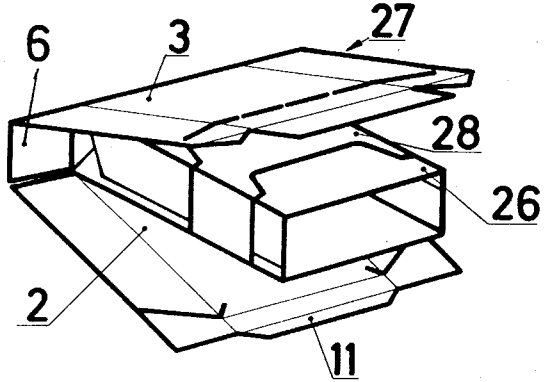

Referring now to FIG. 4, the next step in the practice of the present invention comprises the folding of the outer wrapper 27 such that the bottom defining portion 1 is brought into abutting contact with the bottom of the inner wrapper 26. Thereafter, the front and rear sides, respectively 3 and 2, are folded around the inner wrapper about the scored lines by which they are connected to the bottom defining portion 1.

Figure 5:
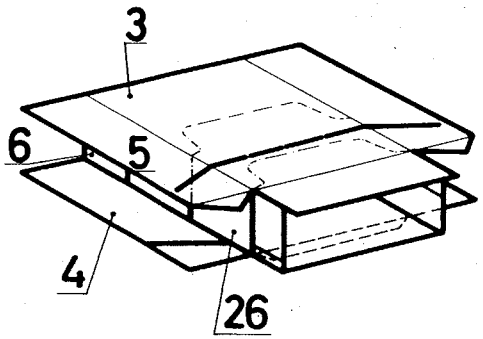
Figure 6:
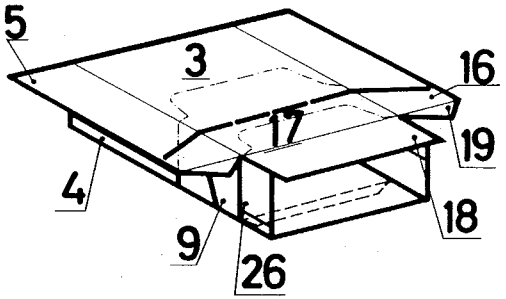
Figure 7:
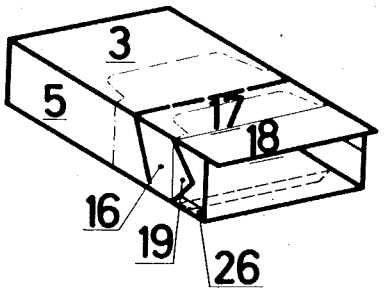
Figure 10:
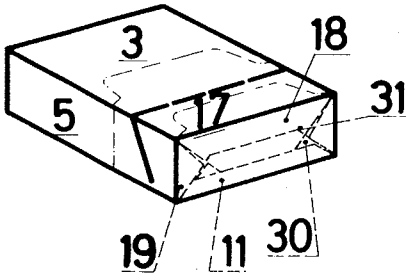
Figure 9:
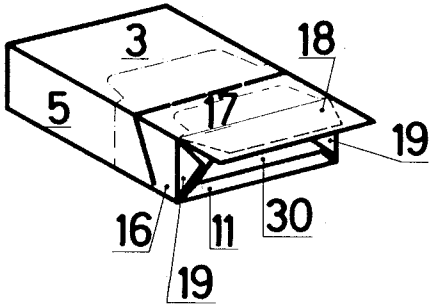

The formation of a hinged-lid package in accordance with the present invention continues in stepwise fashion as depicted in FIGS. 5–10. Thus, subsequent to the folding step(s) of FIG. 4, the bottom end tabs 6 are folded inwardly, as shown in FIG. 5, and then the inner walls 4 are folded onto the bottom end tabs 6 as shown in FIG. 6. Next, the outer side-wall tabs 5 are folded over the inner side-wall defining tabs 4 as shown in FIG. 7.

Figure 8:
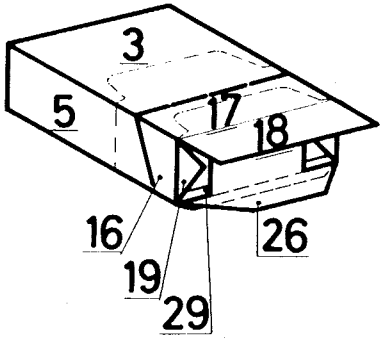

At this point in the procedure, the inner wrapper 26 is still open at the head end. Referring to FIG. 8, the next step comprises the inward folding of the lateral, i.e., triangular shaped, end tabs 19. The inward folding of the tabs 19 causes the folding of the lateral edge or tips 29 of the inner wrapper 26. Subsequently, the tab 11 is folded inwardly thereby causing the inward folding, i.e., the formation, of the bottom fold 30 of the inner wrapper 26. The bevelled side edges of tab 11 permit the tab, when folded inwardly, to lie in the same plane as the inwardly folded end tabs 19. This relationship may be seen from FIG. 9. Next, the covering wall 18 of the hinged lid is folded over onto the tab 11 and the lateral end tabs 19. This results in the formation of a top fold 31 of the inner wrapper 26. The width of the tab 11 is such that the top fold 31 of the inner wrapper is not gripped between tab 11 and the covering wall 18 and thus remains free.

As will be understood and appreciated by those skilled in the art, during the above-described folding operation the bottom end tabs 6 are glued to the side wall tabs 4 which, in turn, are glued to the side wall tabs 9. Also, the covering wall 18 is glued to the tab 11 and the lateral end tabs 19.

Figure 3:
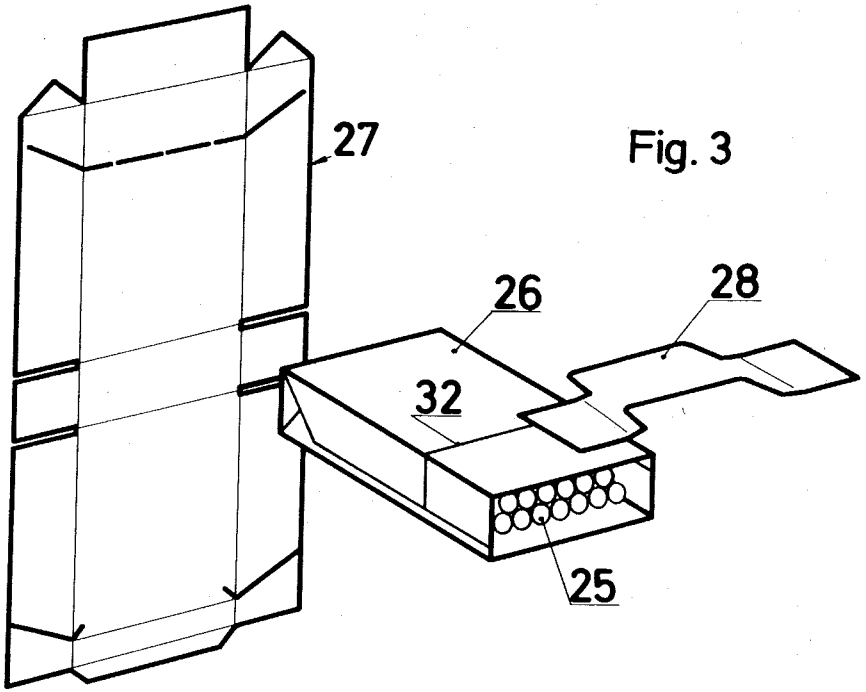
FIGS. 3–10 are perspective views which sequentially show the steps of production of a hinged-lid package in accordance with the method of the present invention.

In the practice of the present invention, the blank from which the inner wrapper 26 is formed can be comprised of two separate portions or, as represented in FIG. 3, the inner wrapper can be an integral member having two sections which are joined via a perforation line 32, such a perforation line being located in the region of the collar 28 on the finished package.

A package produced in accordance with the present invention is opend by breaking the connecting bridges 15 and pivoting the lid about the hinge line 7. The inner wrapper 26 can then be grasped at the head end and the loose portion of the inner wrapper removed. Alternatively, the inner wrapper may be torn at the perforation line 32 and partially removed.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In a box having a generally cuboid shape and a hinged lid, being articulated to the rear side of the box and having a wall which covers a first end of the box in the closed condition of the lid, said covering wall being adhesively secured to a pair of underlying and oppositely disposed lateral end tabs, said lid further having a pair of oppositely disposed side walls which are connected to said end tabs, said lid also including a front wall and a rear wall, the lid front wall being connected to said covering wall and the lid rear wall being connected to the rear side of the box, the box further including an inner wrapper received in the box and folded about the contents of the box, the inner wrapper generally conforming to the shape of the box interior and having a pair of oppositely disposed lateral side edge portions which are folded inwardly toward one another, the improvement comprising:

a tab extending from said lid rear wall, said tab extension having three exposed edges and extending generally transversely with respect to said lid rear wall in the direction of said lid front wall;

said lateral end tabs generally having a triangular shape;

said lid front and side walls being respectively connected to the box front and side walls by narrow strips of material which bridge shear lines between adjacent edges of said connected walls;

said inner wrapper having a first end flap which is folded over said lateral side edge portions and a second end flap which is folded inwardly toward and over said inner wrapper first end flap, said second end flap having a width in the direction of the fold line of the first end flap which is less than the width of the box between the front and rear sides thereof, said tab extension of said lid rear wall extending toward the fold line of the inner wrapper second end flap and in part overlapping the inner wrapper first end flap, the width of said tab extension being selected such that said inner wrapper second end flap does not overlie said tab extension;

whereby the inner wrapper when completely folded is free relative to the box lid.

2. The box of claim 1 further comprising an inner collar which extends at least part way around the first end of the box.

3. The box of claim 1 further comprising an inner collar which extends at least part way around the first end of the box.

4. The box of claim 1 wherein the inner wrapper is provided with a perforation intermediate its length whereby the portion of the inner wrapper which includes said end flaps and side edge portions may be separated from the remainder of the inner wrapper upon opening of said lid.

5. The box of claim 1 wherein said tab extension and said lateral end tabs are generally coplanar and are adhesively secured to the inwardly facing side of said lid covering wall.

6. The box of claim 1 wherein said tab extension and said lateral end are generally coplanar and are adhesively secured to the inwardly facing side of said lid covering wall.

7. The box of claim 6 wherein the inner wrapper is provided with a perforation intermediate its length whereby the portion of the inner wrapper which includes said end flaps and side edge portions may be separated from the remainder of the inner wrapper upon opening of said lid.

8. The box of claim 7 further comprising an inner collar which extends at least part way around the first end of the box.

9. A flat blank for use in the formation of a cigarette package having a generally cuboid shape, the cigarettes being enclosed within an inner wrapper having an open upper end extending above the cigarettes, said blank adapted to be folded about the inner wrapper to close said upper end and to form a lid thereover without capturing the inner wrapper in folds of the lid, said blank comprising: a container defining first section and lid defining second sections, said first section comprising rectangularly shaped portions which define package front, bottom and rear panels which are respectively interconnected by fold lines, said rectangularly shaped portions each having side wall defining tabs extending therefrom, said side wall defining tabs being connected to their associated portions by means of further fold lines, a first of said lid defining sections comprising a lid rear wall defining portion which is connected to said portion of said first section which defines the package rear panel by means of a hinge line, a pair of oppositely disposed lid inner side wall defining portions being connected to said rear wall defining portion by fold lines and being separated from adjacent side wall defining tab extensions of said package rear panel defining portion, another of said blank second sections comprising a lid front wall defining portion having a pair of oppositely disposed lid outer side wall defining portions extending therefrom, a lid cover wall defining portion extending from said lid front wall defining portion and being connected thereto by a fold line, a triangularly shaped lateral end tab extending from each of said lid outer side wall defining portions in the same direction as said lid cover wall defining portion, a cut defining the ends of said first section front panel defining portion and the side wall defining tabs connected thereto which are disposed oppositely with respect to said bottom panel defining portion, said cut being bridged by narrow connecting regions between respective of said front panel defining portion and said lid front wall defining portion and between said lid outer side wall defining portions and respective adjacent package side wall defining tabs, and a further tab of narrow width extending from said lid rear wall defining portion, said further tab having three free sides and being connected to said lid rear wall defining portion by a fold line, the width of said further tab being selected such that said inner wrapper when folded does not overlie said further tab.

10. The blank of claim 9 wherein said further tab has a first end edge which is parallel to the fold line by which the tab is connected to the lid rear wall defining portion, the side edges of said further tab diverging from said first end edge with the angle of divergence being complementary to the angle of the side walls of said lateral end tabs whereby said further tab and lateral end tabs may be folded into a coplanar relationship.

11. The blank of claim 9 wherein the height of said lateral end tabs does not exceed one-half the width of said lid cover wall.

12. The blank of claim 10 wherein the height of said lateral end tabs does not exceed one-half the width of said lid cover wall.

13. The blank of claim 9 wherein the said narrow connecting regions between the lid outer side wall defining portions and adjacent package side wall defining tab extensions are located adjacent the side edges of the blank.

14. The blank of claim 12 wherein the said narrow connecting regions between the lid outer side wall defining portions and adjacent package side wall defining tab extensions are located adjacent the side edges of the blank.

15. A method for the production of the package of claim 5 comprising the steps of:

forming the inner wrapper from a generally rectangular piece of sheet material by folding the sheet material around the article to be packaged, the inner wrapper remaining open at a first end thereof;

folding a package blank about the inner wrapper to form a box-like container open at a first end, said container and inner wrapper first ends facing the same direction, wherein said blank has a generally cuboid shape, and has a container defining first section and lid defining second sections, said first section comprising rectangularly shaped portions which define package front, bottom and rear panels which are respectively interconnected by fold lines, said rectangularly shaped portions each having side wall defining tabs extending therefrom, said side wall defining tabs being connected to their associated portions by means of further fold lines, a first of said lid defining sections comprising a lid rear wall defining portion which is connected to said portion of said first section which defines the package rear panel by means of a hinge line, a pair of oppositely disposed lid inner side wall defining portions being connected to said lid rear wall defining portion by fold lines and being separated from adjacent side wall defining tab extensions of said package rear panel defining portion, another of said blank second sections comprising a lid front wall defining portions having a pair of oppositely disposed lid outer side wall defining portions extending therefrom, a lid cover wall defining portion extending from said lid front wall defining portion and being connected thereto by a fold line, a triangularly shaped lateral end tab extending from each of said lid outer side wall defining portions in the same direction as said lid cover wall defining portion, a cut defining the ends of said first section front panel defining portion and the side wall defining tabs connected thereto which are disposed oppositely with respect to said bottom panel defining portion, said cut being bridged by narrow connecting regions between respective of said front panel defining portion and said lid front wall defining portion and between said lid outer side wall defining portions and respective adjacent package side wall defining tabs, and a further tab of narrow width extending from said lid rear wall defining portion, said further tab having three free sides and being connected to said lid rear wall defining portion by a fold line;

folding the lateral end tabs of the package blank inwardly toward one another to partly close the inner wrapper by forcing inwardly the ends of the lateral sides thereof, the ends tabs being folded into a common plane;

folding the further tab of the package blank into the plane of the folded lateral end tabs thereby further closing the inner wrapper; and folding the lid cover wall over the lateral end tabs to complete the closure of the package.

* * * * *

UNITED STATES PATENT AND TRADEMARK OFFICE

CERTIFICATE OF CORRECTION

PATENT NO. : 4,732,276

DATED : March 22, 1988

INVENTOR(S) : Siegfried Knecht

It is certified that error appears in the above-identified patent and that said Letters Patent is hereby corrected as shown below:

Claim 1, line 2, before "being", insert -- the lid --.

Claim 6, line 2, after "end", insert -- tabs --.

Signed and Sealed this

Twenty-second Day of November, 1988

*Attest:*

DONALD J. QUIGG

*Attesting Officer*

*Commissioner of Patents and Trademarks*